US007017222B2

(12) United States Patent
Dunn

(10) Patent No.: US 7,017,222 B2
(45) Date of Patent: Mar. 28, 2006

(54) BOTTLE-NIPPLE BRUSH

(75) Inventor: Steven B. Dunn, Beverly Hills, CA (US)

(73) Assignee: Munchkin, Inc., Van Nuys, CA (US)

( * ) Notice: Subject to any disclaimer, the term of this patent is extended or adjusted under 35 U.S.C. 154(b) by 351 days.

(21) Appl. No.: 10/260,193

(22) Filed: Sep. 30, 2002

(65) Prior Publication Data

US 2004/0060577 A1 Apr. 1, 2004

(51) Int. Cl.
*A46B 3/18* (2006.01)

(52) U.S. Cl. ..... 15/106; 15/59; 15/164; 15/211; D4/106

(58) Field of Classification Search ..... 15/118, 15/106, 211, 164, 244.1, 160, 184, 59, 104.05; D4/105, 106
See application file for complete search history.

(56) References Cited

U.S. PATENT DOCUMENTS

| | | | | |
|---|---|---|---|---|
| 1,557,655 | A | 10/1925 | Cave et al. | |
| 1,659,622 | A | 2/1928 | Atamian | |
| 1,899,242 | A | 2/1933 | McNab | |
| 2,762,074 | A | 9/1956 | Danchig | |
| 3,130,433 | A | 4/1964 | John | |
| 3,358,311 | A | 12/1967 | Cunningham et al. | |
| 3,358,314 | A | 12/1967 | Matibag | |
| 4,023,677 | A | 5/1977 | Wittner et al. | |
| D250,068 | S | 10/1978 | Ducotey | |
| 4,319,595 | A | 3/1982 | Ulrich | |
| 4,575,892 | A | 3/1986 | Ross | |
| 4,621,387 | A | 11/1986 | Noser | |
| 4,809,389 | A | 3/1989 | Breitschmid | |
| 4,945,598 | A * | 8/1990 | Racioppi | 15/160 |
| D333,368 | S | 2/1993 | Flowers | |
| D334,845 | S | 4/1993 | Ricciareli et al. | |
| 5,306,151 | A | 4/1994 | Rauch | |
| 5,491,863 | A * | 2/1996 | Dunn | 15/106 |
| 5,709,003 | A * | 1/1998 | Batch | 15/106 |
| 6,202,247 | B1 * | 3/2001 | Lorenz, Jr. | 15/118 |

OTHER PUBLICATIONS

John Pritzlaff Hardware Co. © 1952, Milk Bottle Brush—Item No. 39, p. 1234.

* cited by examiner

*Primary Examiner*—John Kim
*Assistant Examiner*—Abraham Bahta
(74) *Attorney, Agent, or Firm*—Knoble Yoshida & Dunleavy, LLC

(57) ABSTRACT

A brush assembly for scrubbing an article such as a baby bottle includes a bottle brush that has a recess defined in its handle and a nipple brush that has a scrubbing end that is sized and shaped to at least partially fit within the recess in a storage position. A second end of the nipple brush is provided with a suction cup that permits the nipple brush to be mounted to a fixed surface, such as a sink. Retention structure is provided for retaining the nipple brush in the storage position with respect to the bottle brush, so that the bottle brush may be used to scrub bottles while the nipple brush, and hence the bottle brush, remains affixed to the fixed surface.

21 Claims, 3 Drawing Sheets

BOTTLE-NIPPLE BRUSH

BACKGROUND OF THE INVENTION

1. Field of the Invention

This invention relates generally to the field of cleaning and sterilization of articles such as baby bottles. More specifically, this invention relates to a combination bottle brush and nipple brush that is designed for convenient, one-handed scrubbing of both baby bottles and baby bottle nipples.

2. Description of the Related Technology

The importance of proper hygiene when handling and cleaning infant feeding equipment such as baby bottles and nursing nipples cannot be overstated. Ideally, bottles and nipples should be thoroughly scrubbed, then sterilized by immersion in boiling water between uses. Proper scrubbing is especially important after a nipple or bottle has been used to dispense fatty liquids, or liquids having suspended solids therein, such as cereal.

Bottle scrubbing brushes are common, as are nipple scrubbing brushes. Kitchens of new parents and other caregivers often include a bottle brush and a nipple brush in addition to a clutter of miscellaneous bottle components, containers of formula or mother's milk, sterilization equipment, bibs and other items that are too numerous to list. Storage space for all of the new paraphernalia in a new parent's kitchen can easily become insufficient. It is important, though, that bottle and nipple brushes, and particularly the latter, be stored in locations where the cleansing surface thereon are not in contact with germ-laden surfaces. To address these concerns, the present inventor developed a combination bottle and nipple brush that is described in U.S. Pat. No. 5,491,863 to Dunn.

Parents and caregivers often have many things to do at once, especially in the kitchen. Accordingly, any task that can be performed without the continuous use of both hands would be welcome because it may permit something else to be done at the same time. Unfortunately, scrubbing baby bottles invariably requires one hand to be kept on the bottle, and the other hand to hold the brush. This is particularly the case for standard, narrow neck baby bottles, in which a fair amount of force is required to a brush into and out of the narrow neck of the bottle. A need exists for an improved method and apparatus that will permit one-handed scrubbing of baby bottles and similar products.

SUMMARY OF THE INVENTION

Accordingly, it is an object of the invention to provide an improved method and apparatus that will permit one-handed scrubbing of baby bottles, particularly standard, narrow neck baby bottles, and similar products.

In order to achieve the above and other objects of the invention, a brush assembly according to a first aspect of the invention includes a bottle brush having a handle with a recess defined therein and a bottle scrubbing portion that is adapted for scrubbing baby bottles; a nipple brush including mounting structure for mounting the nipple brush to a fixed surface and a nipple scrubbing portion that is adapted for scrubbing baby bottle nipples, and wherein the bottle brush and the nipple brush are sized and shaped so that the nipple brush may be attached to the bottle brush in a storage position wherein the nipple scrubbing portion may be positioned within the recess; and retention structure for retaining the nipple brush in the storage position with respect to the bottle brush, the retention means being constructed and arranged so that the nipple brush will be maintained in the storage position when the mounting means is attached to a fixed surface and the bottle brush is being used to scrub a baby bottle.

According to a second aspect of the invention, a method of scrubbing a baby bottle includes steps of securing a first end of a nipple brush within a recess that is defined in a handle of a bottle brush; fastening a second, opposite end of the nipple brush to a fixed surface; and scrubbing a baby bottle with the bottle brush while the bottle brush remains secured to the nipple brush and the nipple brush remains fastened to the fixed surface, whereby convenient, one-handed scrubbing is made possible.

A bottle brush according to a third aspect of the invention includes a bottle scrubbing portion that is adapted for scrubbing baby bottles; and mounting structure for mounting the bottle brush to a fixed surface, the mounting structure having a force of adhesion to the fixed surface that is sufficient to permit a consumer to scrub a baby bottle with one hand without the bottle brush becoming separated from the fixed surface.

A method of scrubbing a baby bottle according to a fourth aspect of the invention includes steps of securing a first end of a bottle brush to a fixed surface; and scrubbing a baby bottle with the bottle brush while the bottle brush remains secured to the fixed surface, whereby convenient, one-handed scrubbing is made possible.

These and various other advantages and features of novelty that characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described a preferred embodiment of the invention.

DETAILED DESCRIPTION OF THE PREFERRED EMBODIMENT(S)

Figure 1:
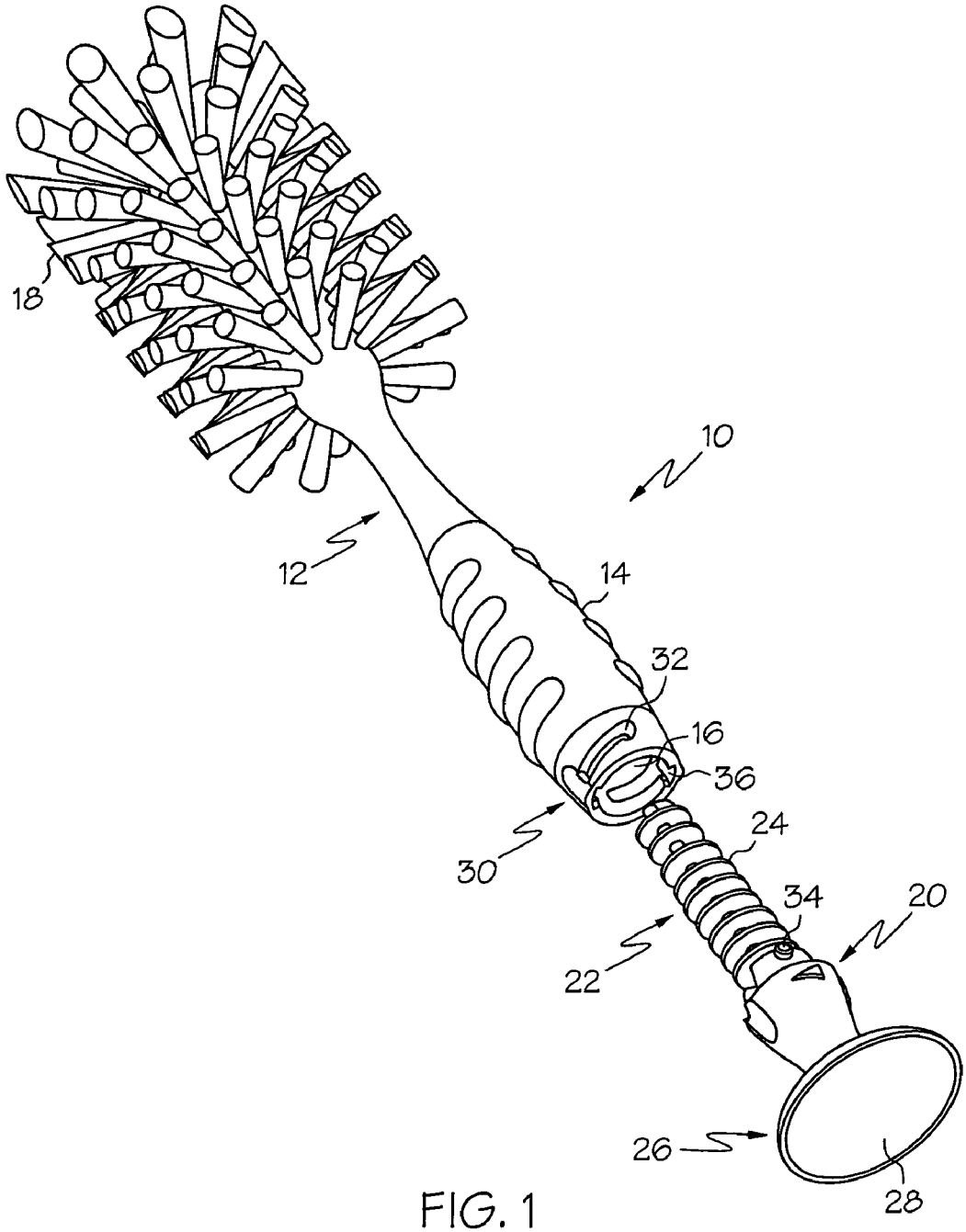
FIG. 1 is exploded perspective view of an article that is constructed according to a preferred embodiment of the invention.

Referring now to the drawings, wherein like reference numerals designate corresponding structure throughout the views, and referring in particular to FIG. 1, a brush assembly 10 that is constructed according to a preferred embodiment of the invention includes a bottle brush 12 having a handle 14 and a bottle scrubbing portion 18. Bottle scrubbing portion 18 preferably includes a multiplicity of bristles, and may also include additional scrubbing elements such as a soft fabric, sponge material, scrubbing mesh or the like. Bottle scrubbing portion 18 is preferably sized and shaped to facilitate the scrubbing of a baby bottle or similar article. Handle 14 is preferably molded so as to have a hard plastic base material and a softer, elastomeric gripping material, such as Kraton™.

Figure 2:
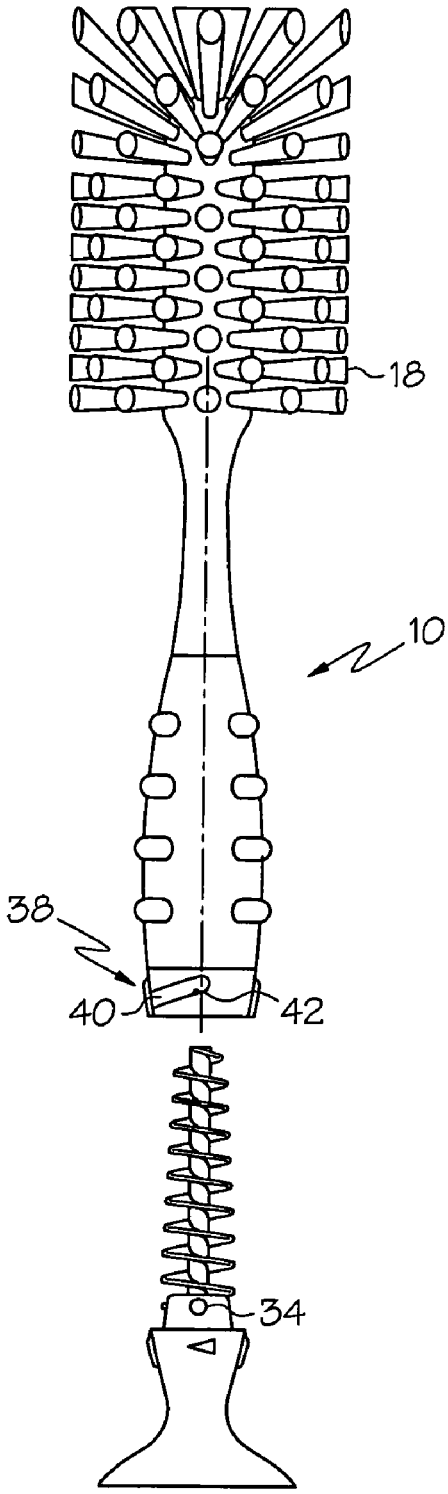
FIG. 2 is an exploded front elevational view of the article that is depicted in FIG. 1.
Figure 3:
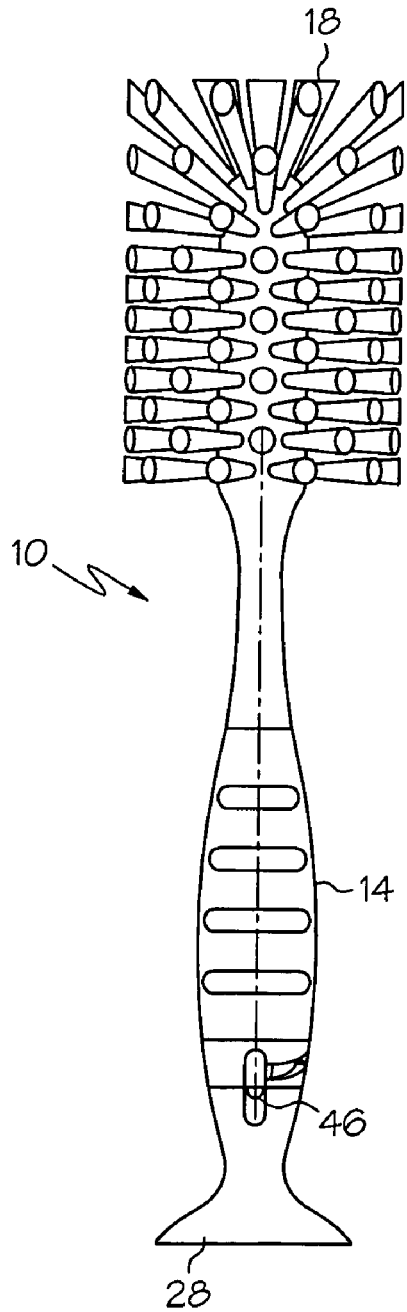
FIG. 3 is a side elevational view of the article that is depicted in the FIGS. 1 and 2.

Brush assembly 10 further includes a nipple brush 20 having a first end 22 with a nipple scrubbing brush 24 and a second end 26 including structure for mounting the nipple brush 20 to a fixed surface, which in the preferred embodiment is a suction cup 28. According to one advantageous feature of the invention, retention structure 30 is provided for retaining the nipple brush 20 in a storage position with respect to bottle brush 10. The storage position, which is illustrated in FIG. 3, is characterized by the nipple scrubbing brush 24 being positioned within a recess 16 that is defined within the handle 14 of the bottle brush 12. In the preferred embodiment, retention structure 30 includes a pair of ventilation openings 32 that are defined in a sidewall of handle 14 and that communicate the recess 16 with the atmosphere outside of the brush assembly 10. Retention structure 30 further includes a corresponding pair of projections 34 that project radially outwardly from the nipple brush 20. A pair of longitudinal grooves 36 are also defined in the inner surface of the outer wall of handle 14, as shown in FIG. 1. Projections 34 are shaped and sized to be received within the grooves 36 in order to insert and withdraw the nipple brush 20 into and out of the bottle brush 12. Longitudinal grooves 36 communicate with the ventilation openings 32 so that the projections 34 may enter the ventilation openings 32 through the longitudinal grooves 36. As may best be seen in FIG. 2, the ventilation openings 32 in effect form a pair of cam channels 38 having cam surfaces 40 that engage the projections 34 and urge the nipple brush 20 toward the bottle brush 12 as the nipple brush 20 is twisted in a predetermined rotational direction relative to the bottle brush 12. A pair of detents 42 at the end of each cam surface 40 are provided to lock the nipple brush 20 in a predetermined rotational position relative to the bottle brush 12 that defines the storage position.

Figure 4:
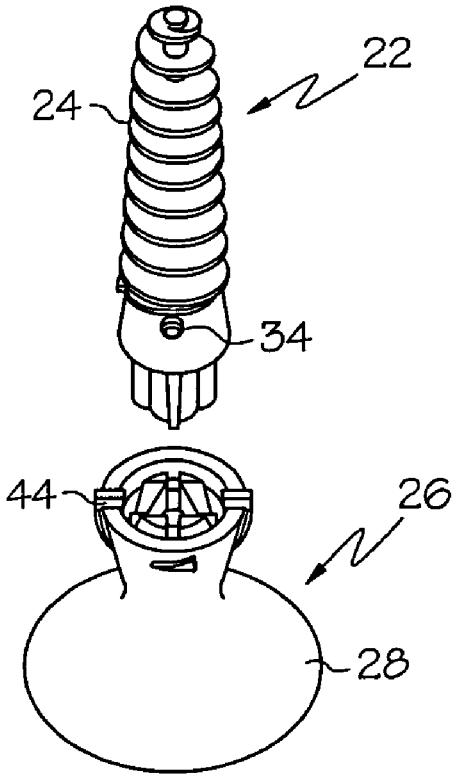
FIG. 4 is an exploded perspective view of one component of the article that is depicted in FIGS. 1–3.

As may best be seen and FIG. 4, a pair of lateral passages 44 are defined in the second end 28 of the nipple brush 20. In the storage position, lateral passages 44 communicate with the longitudinal grooves 36, thereby forming a drainage passageway to permit water to drain out of the otherwise sealed lowermost end of the recess 16. This drainage passageway terminates in a pair of drainage openings 46, as may be seen in FIG. 3.

It will be noted that retention structure 30 serves to releasably secure the nipple brush 20 against axial movement with respect to the bottle brush. Preferably, the retention structure 30 is constructed and arranged to retain the nipple brush 20 in the storage position without separation of the nipple brush 20 from the bottle brush 12 against an axial tensile force of the magnitude that is likely to be developed when scrubbing a standard, narrow neck baby bottle. A standard, narrow neck baby bottle has a neck opening of approximately 1.25 inches.

Preferably, the minimum axial tensile force, under wet conditions, that will be resisted by the retention structure 30 will be at least two pounds, more preferably at least five pounds, and is preferably at least seven pounds. Suction cup 28 is constructed and arranged to mount the nipple brush 20 to a fixed surface with a predetermined force of adhesion. Preferably, retention structure 30 is constructed and arranged to retain the nipple brush 20 in the storage position so as to be able to withstand without separating an axial tensile force that is no less than the predetermined force of adhesion of the suction cup 28. Accordingly, when the nipple brush 20 is in the storage position and the suction cup 28 is affixed to a fixed surface such as a sink or countertop, a consumer may use the bottle scrubbing portion 18 of the brush assembly 10 to scrub a baby bottle or similar article with one hand without fear of the retention structure 30 becoming separated. Preferably, both the retention structure 30 and the suction cup 28 provide a force of attachment that is sufficient to scrub a baby bottle with the brush assembly 10 without the brush assembly 10 as a whole becoming separated from the fixed surface.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. A brush assembly, comprising:

a bottle brush, said bottle brush comprising a handle having a recess defined therein and a bottle scrubbing portion that is adapted for scrubbing baby bottles;

a nipple brush, said nipple brush comprising mounting means for mounting said nipple brush to a fixed surface and a nipple scrubbing portion that is adapted for scrubbing baby bottle nipples, and wherein said bottle brush and said nipple brush are sized and shaped so that said nipple brush is attached to said bottle brush in a storage position wherein said nipple scrubbing portion is positioned within said recess; and retention means for releasably retaining said nipple brush in said storage position with respect to said bottle brush, and wherein:

said retention means has sufficient axial strength to retain said nipple brush in the storage position when said mounting means is attached to a fixed surface and said bottle brush is being used to scrub a standard narrow neck baby bottle; and said mounting means has a sufficient predetermined force of adhesion to remain attached to the fixed surface when said bottle brush is being used to scrub a standard narrow neck baby bottle.

2. A brush assembly according to claim 1, wherein said retention means comprises releasable locking structure for releasably securing said nipple brush against axial movement with respect to said bottle brush.

3. A brush assembly according to claim 1, wherein said retention means is constructed and arranged to retain said nipple brush in said storage position against an axial tensile force of at least one pound.

4. A brush assembly according to claim 1, wherein said mounting means comprises a suction cup.

5. A brush assembly according to claim 4, wherein said retention means is constructed and arranged to retain said nipple brush in said storage position against an axial tensile force that is no less than said predetermined force of adhesion.

6. A brush assembly according to claim 1, wherein said handle of said bottle brush has at least one ventilation opening defined in a sidewall thereof.

7. A brush assembly according to claim 6, wherein said retention means comprises at least one projection on said nipple brush for engaging said ventilation opening.

8. A brush assembly according to claim 7, wherein said handle further has at least one groove defined in an inner surface thereof for permitting said projection to enter and exit said recess when said nipple brush is moved to and from said storage position.

9. A brush assembly according to claim 8, wherein said nipple brush further defines a lateral passage that is in communication with a lower end of said groove when said nipple brush is in the storage position, whereby liquid will be permitted to drain from said recess.

10. A brush assembly according to claim 1, wherein said nipple brush comprises at least one radially extending projection, and wherein said handle of said bottle brush has at least one cam channel defined therein for receiving said projection.

11. A brush assembly according to claim 10, wherein said cam channel comprises a sloped surface for camming said projection so that said nipple brush is drawn toward said bottle brush when said nipple brush is twisted relative to said bottle brush in a predetermined first direction.

12. A brush assembly according to claim 11, further comprising a detent defined in said cam channel for locking said nipple brush in a predetermined rotational position relative to the bottle brush that corresponds to the storage position.

13. A brush assembly according to claim 10, wherein said nipple brush comprises at least two of said projections, and wherein said handle of said bottle brush has a corresponding plurality of cam channels defined therein for respectively receiving said projections.

14. A brush assembly according to claim 3, wherein said retention means is constructed and arranged to retain said nipple brush in said storage position against an axial tensile force of at least two pounds.

15. A brush assembly according to claim 14, wherein said retention means is constructed and arranged to retain said nipple brush in said storage position against an axial tensile force of at least five pounds.

16. A brush assembly according to claim 15, wherein said retention means is constructed and arranged to retain said nipple brush in said storage position against an axial tensile force of at least seven pounds.

17. A brush assembly, comprising:

a bottle brush, said bottle brush comprising a handle having a recess defined therein and a bottle scrubbing portion that is adapted for scrubbing baby bottles;

a nipple brush that is separable in use from said bottle brush, said nipple brush comprising mounting means for mounting said nipple brush to a fixed surface and a nipple scrubbing portion that is adapted for scrubbing baby bottle nipples, and wherein said bottle brush and said nipple brush are sized and shaped so that said nipple brush is attached to said bottle brush in a storage position wherein said nipple scrubbing portion is positioned within said recess; and retention means for releasably retaining said nipple brush in said storage position with respect to said bottle brush, said retention means being constructed and arranged so that said nipple brush will be maintained in the storage position when said mounting means is attached to a fixed surface and said bottle brush is being used to scrub a baby bottle, and wherein said mounting means is constructed and arranged to mount said nipple brush to a fixed surface with a predetermined force of adhesion, and wherein said retention means is constructed and arranged to retain said nipple brush in said storage position against an axial tensile force that is no less than said predetermined force of adhesion.

18. A brush assembly according to claim 17, wherein said retention means is constructed and arranged to retain said nipple brush in said storage position against an axial tensile force of at least one pound.

19. A brush assembly according to claim 18, wherein said retention means is constructed and arranged to retain said nipple brush in said storage position against an axial tensile force of at least two pounds.

20. A brush assembly according to claim 19, wherein said retention means is constructed and arranged to retain said nipple brush in said storage position against an axial tensile force of at least five pounds.

21. A brush assembly according to claim 20, wherein said retention means is constructed and arranged to retain said nipple brush in said storage position against an axial tensile force of at least seven pounds.

* * * * *